United States Patent [19]

Suzuki et al.

[11] 4,337,801

[45] Jul. 6, 1982

[54] DEVICE FOR SHEDDING WARP YARNS IN A WEAVING LOOM

[75] Inventors: Hajime Suzuki, Anjo; Yoshifumi Umemura, Toyoake; Shozo Ueda, Kariya, all of Japan

[73] Assignee: Kabushiki Kaisha Toyoda Jidoshokki Seisakusho, Aichi, Japan

[21] Appl. No.: 171,376

[22] Filed: Jul. 23, 1980

[30] Foreign Application Priority Data

Jul. 26, 1979 [JP] Japan ..... 54-95860

[51] Int. Cl.[3] ..... D03C 5/00

[52] U.S. Cl. ..... 139/57; 139/79

[58] Field of Search ..... 139/55.1, 57, 58, 79, 139/81

[56] References Cited

U.S. PATENT DOCUMENTS

| | | | |
|---|---|---|---|
| 2,408,645 | 10/1946 | Hunt | 139/79 |
| 3,108,617 | 10/1963 | Nichols | 139/79 |
| 3,168,116 | 2/1965 | Krenz | 139/57 |
| 4,170,250 | 10/1979 | Farley | 139/79 |

FOREIGN PATENT DOCUMENTS

| | | | |
|---|---|---|---|
| 746687 | 8/1944 | Fed. Rep. of Germany | 139/79 |
| 760560 | 12/1953 | Fed. Rep. of Germany | 139/81 |
| 52-3022 | 1/1977 | Japan . | |

*Primary Examiner*—Henry Jaudon

*Attorney, Agent, or Firm*—Burgess, Ryan and Wayne

[57] ABSTRACT

A device for shedding warp yarns in a weaving loom, such as a jet loom, comprises: cranks supported on machine frames of the loom rotatable in synchronization with the weaving operation of the loom; synchronizing levers swingably pivoted; connecting rods connecting the cranks with synchronizing levers so that the rotational movement of the cranks is transmitted as a swinging motion of the synchronizing levers; synchronizing links linked with the synchronizing levers; rocking levers linked with the synchronizing links so that the rotational movement of the cranks is transmitted as a swinging motion of the rocking levers through the swinging motion of the synchronizing levers; and heddle frames, for the upper and lower warp yarns, operated by the rocking levers. The synchronizing levers and synchronizing links are so arranged that, when the connecting rods are located at their dead points which correspond to the uppermost or lowermost position of the heddle frame, one of linking pivots linking synchronizing levers with the synchronizing links is near a line formed by the synchronizing levers and links when they are at their dead points. As a result, the time period wherein the warp yarns serve as upper warp yarns is made different from the time period wherein the warp yarns serve as lower warp yarns, and a difference in tension is created in the upper and lower warp yarns when the beating operation is effected.

6 Claims, 6 Drawing Figures

DEVICE FOR SHEDDING WARP YARNS IN A WEAVING LOOM

FIELD TO WHICH THE PRESENT INVENTION RELATES

The present invention relates to a device for shedding warp yarns in a weaving loom, especially a high speed weaving loom for plain woven fabrics, such as a jet loom.

PRIOR ART OF THE INVENTION

In a conventionally known warp yarn shedding method, a certain amount of differences in the tension are created between the upper and lower warp yarns when they are beaten in order to prevent such defects as reed marks being caused in the obtained woven fabric and to obtain a woven fabric having a superior quality. With regard to such a method, Japanese Patent Application Publication No. 52-3022 discloses an apparatus wherein shedding cams which independently drive heddle frames have an upper lift portion for lifting warp yarns and a lower lift portion for lowering warp yarns, and the cam angle of the upper lift portion is different from that of the lower lift portion. As a result, the time period wherein the warp yarns are retained at the upper level as upper warp yarns is different from the time period wherein the warp yarns are retained at the lower level as lower warp yarns. The beating operation is effected when the shedding angle of the upper warp yarns is different from that of the lower warp yarns, and accordingly, a difference in the tension in the upper and lower weft yarns is created when the warp yarns are beaten. As a result, a woven fabric having a good weave and hand can be produced. However, such an apparatus wherein shedding cams are utilized has a disadvantage in that, when the operating speed of the weaving loom is increased, the acceleration of the parts driven by the cams is excessively increased and the apparatus is subjected to an excessive mechanical force.

To obviate the above-mentioned disadvantage, an apparatus, for shedding warp yarns, which utilizes simple crank motion in order to increase the operating speed has been proposed. However, in this apparatus, the upper warp yarns are open at almost the same time the lower warp yarn are open, and accordingly, the apparatus per se cannot produce a difference in the tension in the upper and lower warp yarns. In other words, the apparatus requires additional means by which the difference in the tension in the upper and lower warp yarns can be created in accordance with the shedding motion of the warp yarns.

SUMMARY OF THE INVENTION

An object of the present invention is to provide a device for shedding warp yarns in a weaving loom in which a crank mechanism is interlinked with a link mechanism and by which the time period wherein the warp yarns are open as upper warp yarns is made longer than that wherein the warp yarns are open as lower warp yarns, or the time period wherein the warp yarns are open as lower warp yarns is made longer than that wherein the warp yarns are open as upper warp yarns, and a difference in tension is created between the upper and lower warp yarns. Utilizing the device of the present invention for shedding warp yarns, a woven fabric having a good weave and hand can be produced at a high speed in a high speed weaving loom, such as a water or air jet loom.

The above-described object of the present invention is achieved by a device for shedding warp yarns in a weaving loom, which is characterized in that: cranks are rotatable about rotational centers in synchronization with the weaving operation of the weaving loom; synchronizing levers are pivoted swingably around swinging centers; connecting rods operably connect the cranks to the synchronizing levers via connecting pivots; and synchronizing links are operably linked with the synchronizing levers via linking pivots and linked with lift members for vertically moving heddle frames via linking pins. The synchronizing levers and the synchronizing links are so arranged that, when the connecting rods are located at their dead points, which correspond to the outermost locations of the heddle frames, and the rotational centers of the cranks and the connecting pivots between the cranks and the synchronizing levers are aligned with first imaginary lines, one of the linking pivots between the synchronizing levers and the synchronizing links becomes near a second imaginary straight line, which connects the linking pin corresponding to the synchronizing link, which is located at its dead point and the swinging center. Consequently, the corresponding synchronizing link and the synchronizing lever linked therewith are substantially aligned with the second imaginary straight line when the connecting rods are located at their dead points.

BRIEF DESCRIPTION OF THE DRAWINGS

Some embodiments constructed in accordance with the present invention will now be explained with reference to the accompanying drawings, wherein.

DETAILED DESCRIPTION OF THE INVENTION

Figure 1:
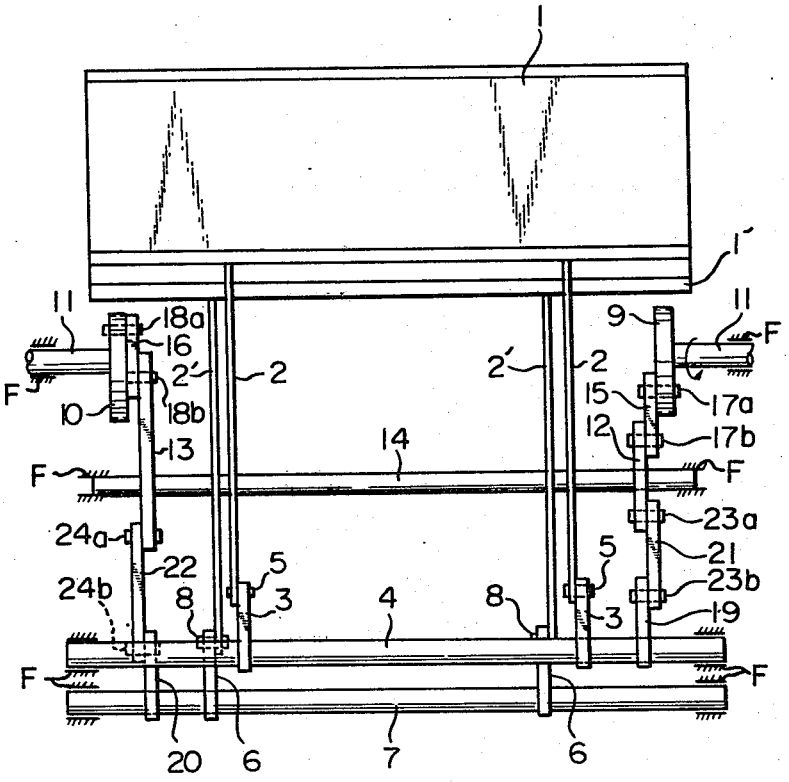
FIG. 1 is an elevational view of a first embodiment of the device for shedding warp yarns according to the present invention.
Figure 2:
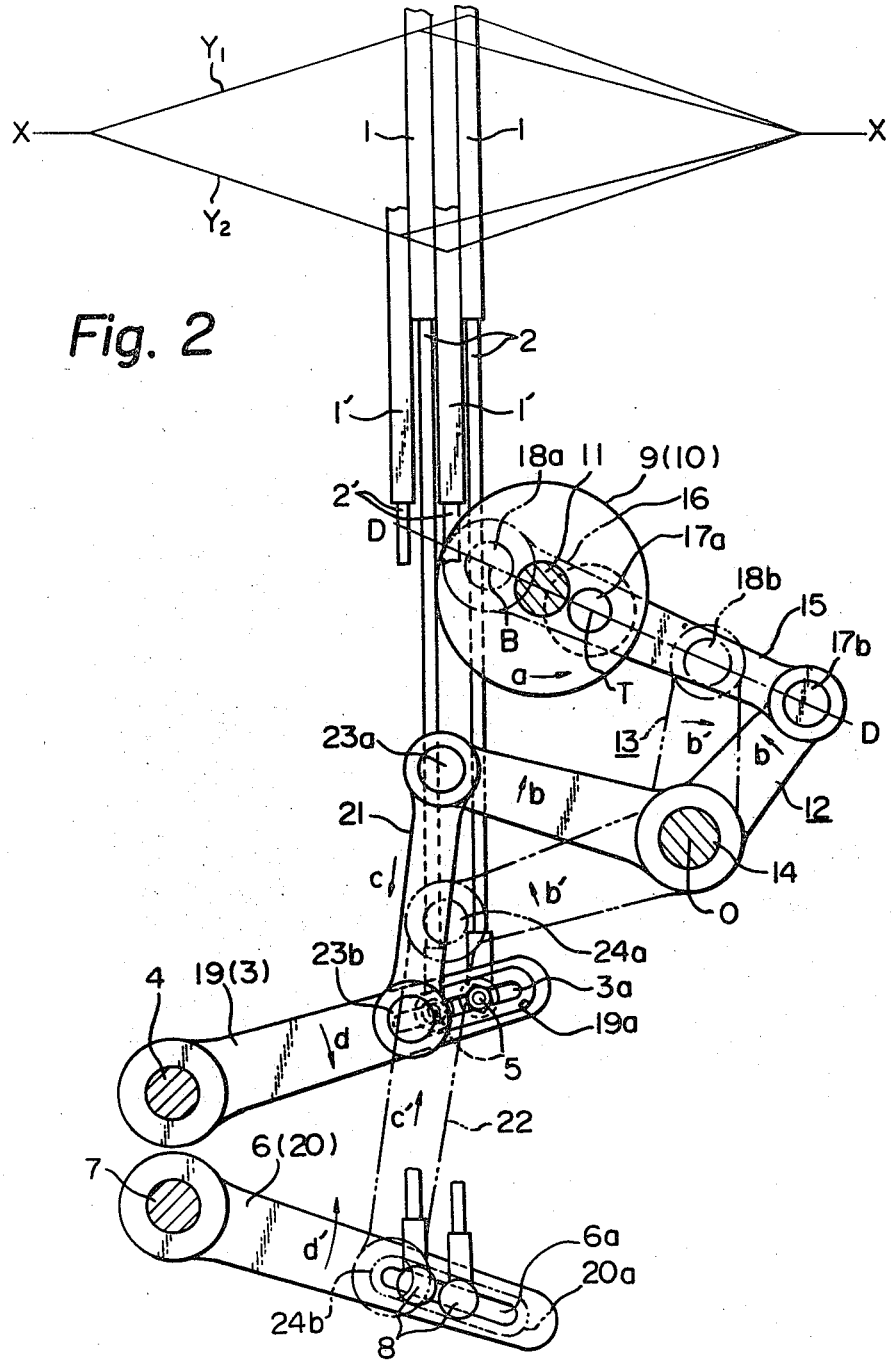
FIG. 2 is an enlarged right side view of the device illustrated in FIG. 1, wherein some parts are omitted.

Referring to FIGS. 1 and 2, four heddle frames 1 and 1', which effect the shedding operation of warp yarns, are disposed so that they are movable vertically on a machine frame via guide members (not shown). Each of the heddle frames 1 or 1' has two pushing up rods 2 or 2' suspended from the lower right and left ends thereof in FIG. 1. A pair of pushing up levers 3 has base portions, connected to a support shaft 4 which is rotatably supported between right and left machine frames F in FIG. 1, and slots 3*a* (FIG. 2) formed at the front portions thereof. The lower ends of the pushing up rods 2 connected to the first and third heddle frames are linked with the slots 3a by means of pins 5, so that the lower ends can be moved along the slots 3a.

Another pair of pushing up levers 6 has base portions, connected to another support shaft 7 which is rotatably supported at a position just beneath the support shaft 4, and slots 6a (FIG. 2) formed at the front portions thereof. The lower ends of the pushing up rods 2' connected to the second and fourth heddle frames 1' are linked with the slots 6a by means of the pin 8, so that the lower ends can be moved along the slots 6a.

A pair of spindles 11 is rotatably supported on the right and left frames F so that they are rotated in synchronization with the weaving operation of the weaving loom. Disc shaped cranks 9 and 10 are connected to the top ends of the spindles 11, respectively. A support shaft 14 is disposed at a position which is lower than the spindles 11 but is horizontally deviated therefrom, and the support shaft 14 rotatably supports synchronizing levers 12 and 13 which are formed in a V-shape. Connecting rods 15 and 16 are linked with the cranks 9 and 10 via crank pins 17a and 18a, respectively, and are also linked with the upper end of the synchronizing levers 12 and 13 via pivots 17b and 18b, respectively, so that the rotational movement of the cranks 9 and 10 is transmitted to the synchronizing levers 12 and 13 as a swinging motion.

Rocking levers 19 and 20 have base portions fixedly secured to the support shafts 4 and 7, and slots 19a and 20a formed at the front end thereof, respectively. Synchronizing lines 21 and 22 have upper ends pivotably linked with the lower ends of the synchronizing levers 12 and 13 via linking pivots 23a and 24a, respectively, and lower ends pivotably linked with the front ends of the rocking levers 19 and 20 via linking pins 23b and 24b, respectively, so that the swinging motion of the synchronizing levers 12 and 13 is transmitted to the rocking levers 19 and 20.

Figure 3:
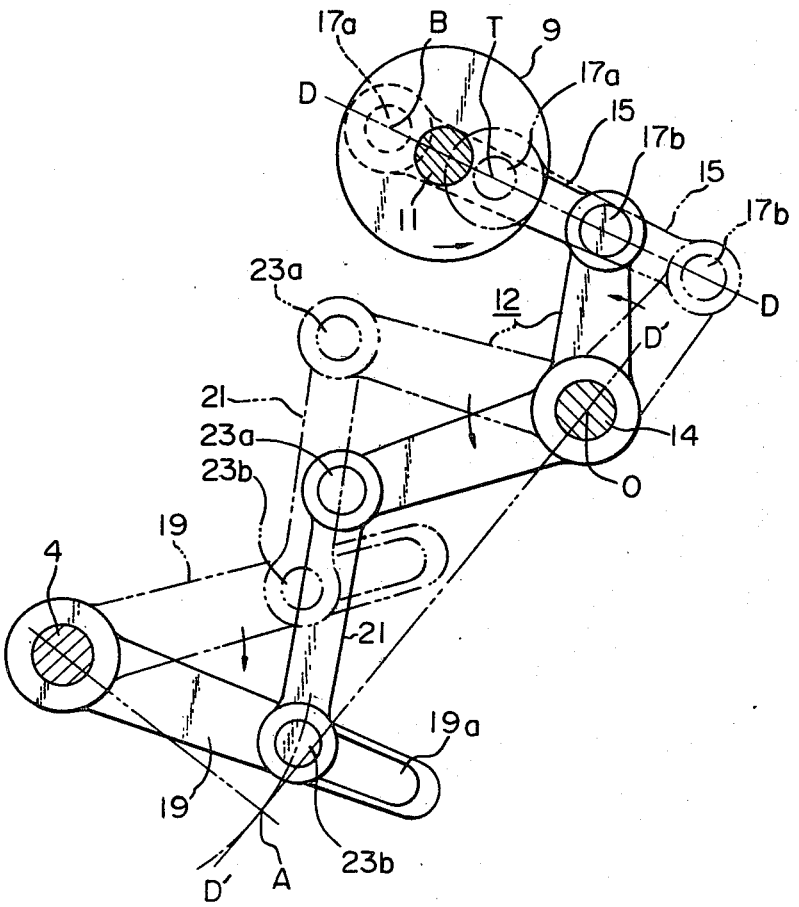
FIG. 3 is an enlarged partial side view of the device illustrated in FIG. 2, wherein the heddle frame connected to the parts are moved to their lowermost positions.

The solid lines in FIG. 2 and two-dot and dash lines in FIG. 3 illustrate a condition wherein the heddle frames 1 are moved to their uppermost positions and the other heddle frames 1' are moved to their lowermost positions, and wherein the upper warp yarn $Y_1$ and the lower warp yarn $Y_2$ are opened most. Under this condition, the connecting rod 15 interconnected with the heddle frames 1 located at their uppermost positions is located at its dead point and is aligned with a first imaginary straight line D—D, which passes through the center of the spindle 11, the crank pin 17a and the connecting pivot 17b, and; the crank pin 17a connecting the connecting rod 15 to the crank 9 is moved to the position T corresponding to the heddle frames 1 located at their uppermost positions. At this time, as illustrated by a two-dot and dash line in FIG. 3, the linking pin 23a linking the upper portion of the synchronizing link 21 with the synchronizing lever 12 is located away from a second imaginary straight line D'—D' which passes through the center O of the support shaft 14 and the position A where the linking pin 23b is located when the synchronizing link 21 is located at its dead point. It should be noted that the synchronizing link 21 and the lower portion of synchronizing lever 12 are aligned with the second imaginary straight line D'—D' when the synchronizing link 21 is located at its dead point.

Contrary to the above, the other connecting rod 16 connected to the heddle frames 1' located at their lowermost positions is located near the first imaginary line D—D, as illustrated by a two-dot and dash line in FIG. 2, and the crank pin 18a connecting the connecting rod 16 to the crank 10 is moved to the bottom position B which corresponds to the heddle frames 1' located at their lowermost positions. At this time, the linking pivot 24a linking the synchronizing link 22 with the synchronizing lever 13 is located near another second imaginary straight line (not shown), which corresponds to the above-mentioned second imaginary straight line and with which the synchronizing link 22 and the lower portion of the synchronizing lever 13 are aligned when the synchronizing link 22 is located at its dead point.

The operation of the thus constructed device for shedding warp yarns will now be explained. In FIG. 2, when the crank 9 is rotated counterclockwise as denoted by an arrow a, the synchronizing lever 12 is swung counterclockwise about the support shaft 14 via the connecting rod 15 as denoted by an arrow b. This swinging motion is transmitted to the rocking lever 19 and the support shaft 4 through the synchronizing link 21, so that the support shaft 4 is swung clockwise as denoted by an arrow d. Thereafter, the swinging motion is further transmitted to the pushing up lever 3 through the support shaft 4, so that the pushing up lever 3 is lowered in a direction denoted by an arrow c. The pushing rod 2 is also lowered so that the heddle frames 1 are lowered together with the upper yarns passing through the heddle eyes formed therein. When the crank 9 is rotated counterclockwise as denoted by an arrow a and the connecting rod 15 is moved from the top position T illustrated by a solid line in FIG. 2 to the bottom position B illustrated by a two-dot and dash line, the linking pivot 23a is moved to a position which is near the second imaginary straight line D'—D' as illustrated by a solid line in FIG. 3. Consequently the heddle frames 1 are moved to the lowermost positions and the warp yarns which have been the upper warp yarns $Y_1$ (FIG. 2) are changed to the lower warp yarns $Y_2$.

In synchronization with the lowering movement of the heddle frames 1, the other heddle frames 1' are moved upwards. More specifically, when the crank 10 is rotated counterclockwise in FIG. 2, the synchronizing lever 13 denoted by a two-dot and dash line in FIG. 2 is swung clockwise about the support shaft 14, as denoted by an arrow b', via the connecting rod 16. This swinging motion is transmitted to the support shaft 7 through the synchronizing link 22 and the rocking lever 20, and then, it is transmitted to the pushing up lever 6 from the support shaft 7. As a result, the pushing up rod 2' is moved upwards and, thereby, the heddle frames 1' are moved upwards together with lower warp yarns $Y_2$. After the displacement of the connecting rod 16 from the bottom portion B to the top portion T is completed, the heddle frames 1' are located at the uppermost positions, so that the warp yarns $Y_2$ which have been the lower warp yarns are changed to the upper warp yarns.

In the above-explained embodiment of the present invention, when the heddle frames 1 or 1' are moved to the lowermost positions, that is, when the connecting rod 15 or 16 is located at the bottom position B on the first imaginary straight line D—D or a position near the bottom position B, the synchronizing lever 12 or 13 and the synchronizing link 21 or 22 become close to the second imaginary straight line D'—D'. Accordingly, when the crank pins 17a and 18a linking the connecting rods 15 and 16 with the cranks 9 and 10, respectively, pass through the bottom positions B, the motion of the synchronizing levers 12 and 13 becomes the slowest. In addition, when the synchronizing links 21 and 22 pass through the positions located near the second imaginary straight lines D'—D', the motion of the rocking levers 19 and 20 becomes the slowest. As a synergistic result of the slowest motions, the time period wherein the heddle frames 1 and 1' are moved slowly at their lowermost positions can be long.

Figure 4:
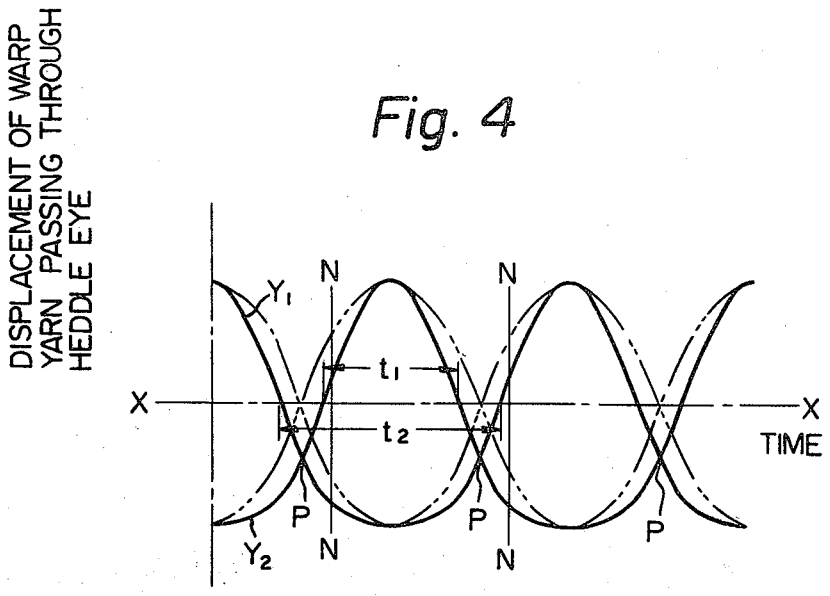
FIG. 4 is a diagram which illustrates the relationship between time and displacement of a warp yarn passing through a heddle eye formed on a heddle operated by the device illustrated in FIGS. 1 through 3.

The above-explained shedding operation of the warp yarns $Y_1$ and $Y_2$ is illustrated in a diagram in FIG. 4. As is apparent from the diagram, the time period $t_1$, wherein the warp yarn serves as an upper warp yarn $Y_1$ and is located above the neutral warp line X—X which passes through the vertical center of the displacements of the upper and lower warp yarns $Y_1$ and $Y_2$, is shorter than the time period $t_2$, wherein the warp yarn serves as a lower warp yarn $Y_2$ and is located below the neutral warp line X—X. Accordingly, the point P where the upper and lower warp yarns $Y_1$ and $Y_2$ cross each other, i.e., the closing point, is deviated downward from the neutral warp line X—X. When a beating operation is effected at a time N in FIG. 4, a difference in the tension can be created in the upper and lower warp yarns $Y_1$ and $Y_2$, and accordingly, a woven fabric having a good weave and hand can be produced.

The two-dot and dash lines in FIG. 4 illustrate the shedding operation of the upper and lower warp yarns, which operation is created by a device wherein only a simple crank motion is utilized. More specifically, referring to FIG. 2, this device consists of rotatable cranks 9 and 10, swingable synchronizing levers 12 and 13, connecting rods 15 and 16 for interlinking the cranks 9 and 10 with the synchronizing levers 12 and 13, heddle frames 1 and 1', and pushing up rods 2 and 2' for operating the heddle frames 1 and 1' in accordance with the movement of the synchronizing levers 12 and 13. In other words, this device does not include the synchronizing links 21 and 22, the rocking levers 19 and 20, and the pushing up levers 3 of the present invention.

As explained above, according to the above-explained embodiment of the present invention, the difference in tension can be created in the upper warp yarns $Y_1$ and lower warp yarns $Y_2$, and the point P where the upper warp yarns $Y_1$ and the lower warp yarns $Y_2$ cross each other is located below the neutral warp line X—X where the tension in the warp yarns becomes the lowest. Accordingly, the shedding operation of the warp yarns can be smoothly effected without causing any entanglement of the warp yarns, and a weft yarn can be filled without causing any weft stop. Furthermore, in the device of the present invention, since crank motion mechanisms are utilized, the device can be operated at high speed.

Figure 5:
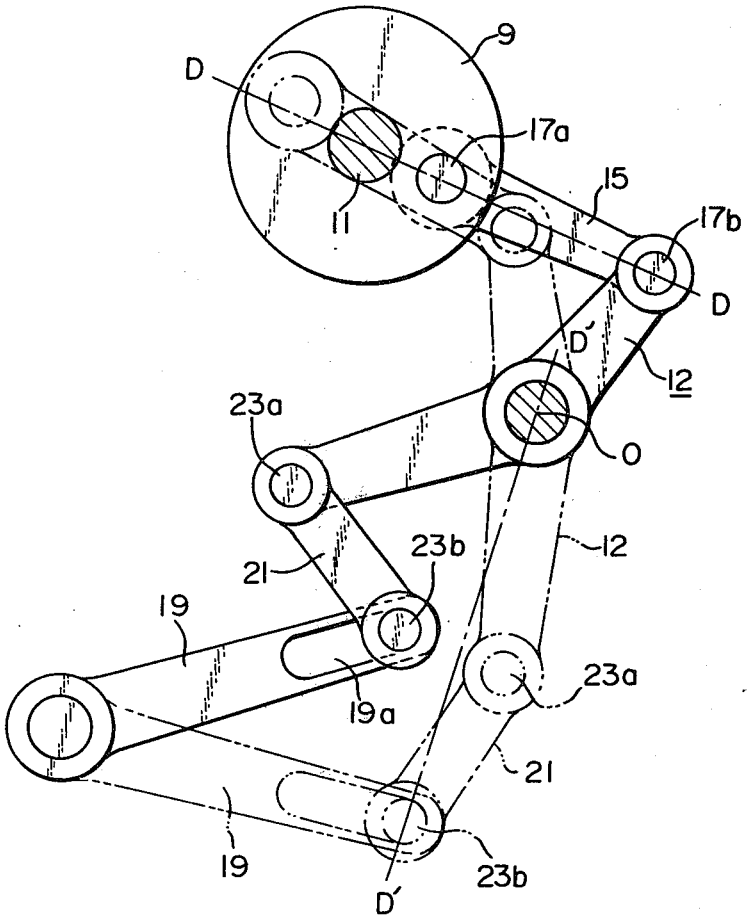
FIG. 5 is an enlarged right side view of a second embodiment of the device according to the present invention.

Another embodiment of the present invention will now be explained with reference to FIG. 5. In FIG. 5, the device is so arranged that the synchronizing lever 12 and the synchronizing link 21 are substantially aligned with the second imaginary straight line D'—D' when the heddle frames 1 (FIG. 2) are moved to their lowermost positions. According to this embodiment, the time period wherein the warp yarns serve as lower warp yarns can be longer than the corresponding time period obtained by the above-explained embodiment. Therefore, the deviation of the point P where the upper warp yarns $Y_1$ and lower warp yarns $Y_2$ cross each other from the neutral warp line X—X (not shown) can be large, and the difference in the tension in the upper and lower warp yarns $Y_1$ and $Y_2$ can be large.

Figure 6:
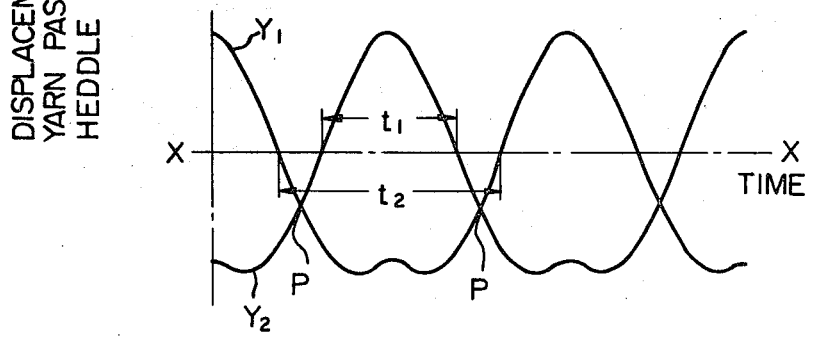
FIG. 6 is a diagram which illustrates the relationship between time and displacement of a warp yarn passing through a heddle eye formed on a heddle operated by the device illustrated in FIG. 5.

When the synchronizing lever 12 and the synchronizing link 21 are so arranged, as illustrated by a two-dot and dash line in FIG. 5, that the linking pivot 23*a* linking them together moves to the right across the second imaginary straight line D'—D' when the heddle frames 1 are located at this lowermost positions, the shedding operation of the upper and lower warp yarns $Y_1$ and $Y_2$ takes place in accordance with the diagram illustrated in FIG. 6. More specifically, the time period wherein the warp yarns serve as the lower warp yarns $Y_2$ is further extended, and accordingly, the difference in the tension between the upper and lower warp yarns when the beating operation is effected can be larger. As explained above, in this embodiment, the time period $t_2$ wherein the warp yarns serve as the lower warp yarns $Y_2$ can be long. If the embodiment is applied to a weaving loom, such as a water jet loom or an air jet loom, wherein guides which are moved into and from the openings of the warp yarns are utilized to guide a weft yarn when it is filled, the time period wherein the weft yarn is filled can be long.

In the above-explained embodiments, the point P where the upper and lower warp yarns cross each other is located below the neutral warp line X—X. However, it is also possible that the sizes of the synchronizing levers 12 and 13, the synchronizing links 21 and 22, and the rocking levers 19 and 20 are so changed that the heddle frames 1 and 1' are moved slowly when they are located at their uppermost positions, and that the point P where the upper and lower warp yarns cross each other is located above the neutral warp line X—X.

In the above-explained embodiments, each of the synchronizing levers 12 and 13 is formed in one body having a V-shape. It is also possible that each of the synchronizing levers consist of two bars which are separated from each other. In this case, the bars are independently and fixedly secured to the support shaft 14. The synchronizing lever may also be formed as a straight lever, wherein the base portion of the lever is swingably supported and the front portion of the lever is connected to the synchronizing link 21 or 22.

According to the present invention, the time period wherein the warp yarns serve as the upper warp yarns is made different from the time period wherein the warp yarns serve as the lower warp yarns, and a difference in the tension can be created between the upper warp yarn and the lower warp yarn when the beating operation is effected. Accordingly, a woven fabric having a good weave and hand can be produced at a high speed, and the shedding operation can smoothly be effected without causing a weft stop.

We claim:

1. A device for shedding warp yarns in a weaving loom, comprising:

(a) cranks rotatable about rotational centers in synchronization with the weaving operation of said weaving loom;

(b) synchronizing levers pivoted swingably around swinging centers;

(c) connecting rods operably connecting said cranks to said synchronizing levers via connecting pivots;

(d) synchronizing links operably linked with said synchronizing levers via linking pivots and linked with lift members for vertically moving heddle frames via linking pins; and (e) wherein said synchronizing levers and said synchronizing links are so arranged that, when said connecting rods are located at their dead points, which correspond to the outermost positions of said heddle frames, and said rotational centers of said cranks and said connecting pivots between said cranks and said synchronizing levers are aligned with first imaginary straight lines, one of said linking pivots between said synchronizing levers and said synchronizing links is near a second imaginary straight line which passes through the corresponding linking pin, while the corresponding synchronizing link is located at its dead point, and the corresponding swinging center.

2. A device for shedding warp yarns in a weaving loom according to claim 1, wherein said synchronizing levers and said synchronizing links are so arranged that, when said connecting rods are located at their dead points, said one of said linking pivots lies on said second imaginary straight line and the corresponding synchronizing lever and the corresponding synchronizing link are aligned with said second imaginary straight line.

3. A device for shedding warp yarns in a weaving loom according to claim 1, wherein said synchronizing levers and said synchronizing links are so arranged that, when said connecting rods are located at their dead points, said one of said linking pivots is across said second imaginary straight line from the position when the connecting rod is at its other dead point.

4. A device for shedding warp yarns in a weaving loom according to claim 1 or 2 or 3, wherein each of said synchronizing levers are formed in a V shape so that the ends thereof extend in different directions from the swinging center.

5. A deivce for shedding warp yarns in a weaving loom according to claim 4, wherein said ends of said synchronizing lever are formed in one body.

6. A device for shedding warp yarns in a weaving loom according to claim 1 or 2 or 3, wherein said lift members for vertically moving heddle frames are formed by rocking levers which are reciprocally pivoted.

* * * * *